US006220233B1

(12) United States Patent
Pierpont

(10) Patent No.: US 6,220,233 B1
(45) Date of Patent: Apr. 24, 2001

(54) EXHAUST GAS RECIRCULATION SYSTEM HAVING VARIABLE VALVE TIMING AND METHOD OF USING SAME IN AN INTERNAL COMBUSTION ENGINE

(75) Inventor: David A. Pierpont, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/416,717

(22) Filed: Oct. 13, 1999

(51) Int. Cl.[7] ..... F02M 25/07
(52) U.S. Cl. ..... 123/568.12; 123/568.21
(58) Field of Search ..... 123/568.11, 568.12, 123/568.13, 568.21, 568.23, 568.24, 568.26, 568.27; 60/605.2

(56) References Cited

U.S. PATENT DOCUMENTS

| | | | | |
|---|---|---|---|---|
| 4,100,734 | | 7/1978 | Ozaki et al. | 60/278 |
| 4,105,010 | | 8/1978 | Rand, Jr. | 123/198 F |
| 4,186,698 | | 2/1980 | Aoyama | 123/676 |
| 4,303,053 | | 12/1981 | Etoh et al. | 123/568.2 |
| 4,316,438 | | 2/1982 | Iizuka | 123/198 F |
| 4,475,524 | | 10/1984 | Eckert et al. | 123/568.17 |
| 4,762,107 | * | 8/1988 | Schoneck et al. | 123/568.21 |
| 4,956,975 | * | 9/1990 | Fortnagel et al. | 60/605.2 |
| 5,121,734 | | 6/1992 | Grieshaber et al. | 123/568.17 |
| 5,178,119 | | 1/1993 | Gale | 123/568.12 |
| 5,209,209 | | 5/1993 | Karlsson et al. | 123/568.17 |
| 5,511,531 | | 4/1996 | Cook et al. | 123/568.21 |
| 5,517,976 | | 5/1996 | Bachle et al. | 123/568.11 |
| 5,711,154 | | 1/1998 | Baechle et al. | 60/605.2 |
| 5,740,785 | * | 4/1998 | Dickey et al. | 123/568.24 |
| 5,791,146 | * | 8/1998 | Dungner | 60/605.2 |
| 5,794,445 | * | 8/1998 | Dungner | 60/605.2 |
| 5,802,846 | * | 9/1998 | Bailey | 123/568.12 |
| 6,003,315 | * | 12/1999 | Bailey | 60/605.2 |
| 6,009,709 | * | 1/2000 | Bailey | 60/605.2 |
| 6,038,860 | * | 3/2000 | Bailey | 60/605.2 |
| 6,053,154 | * | 4/2000 | Pott | 123/568.12 |
| 6,138,650 | * | 10/2000 | Bailey | 123/568.12 |

* cited by examiner

*Primary Examiner*—Willis R. Wolfe
(74) *Attorney, Agent, or Firm*—Todd T. Taylor

(57) ABSTRACT

An exhaust gas recirculation system for an internal combustion engine includes an exhaust gas recirculation valve adapted for coupling to an intake manifold and adapted for connection to an secondary exhaust outlet. The exhaust gas recirculation valve is controllably positioned in one of a first position and a second position, wherein when the exhaust gas recirculation valve is in the first position the exhaust gas from each cylinder is transported through the primary exhaust outlet, and when the exhaust gas recirculation valve is in the second position an exhaust gas flow from at least one of the plurality of combustion cylinders is transported through the secondary exhaust outlet. An actuator is placed in communication with the exhaust gas recirculation valve for effecting a position change thereof. A controller is coupled to the actuator to control a timing of movement of the exhaust gas recirculation valve between the first position and the second position based on at least one cyclical engine operation characteristic of the internal combustion engine.

20 Claims, 2 Drawing Sheets

EXHAUST GAS RECIRCULATION SYSTEM HAVING VARIABLE VALVE TIMING AND METHOD OF USING SAME IN AN INTERNAL COMBUSTION ENGINE

TECHNICAL FIELD

The present invention relates to internal combustion engines, and, more particularly, to exhaust gas recirculation systems in such engines.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NOx). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably introduced to the intake air stream downstream of the compressor and air-to-air after cooler (ATAAC). Introducing the exhaust gas downstream of the compressor and ATAAC is preferred due to the reliability and maintainability concerns that arise if the exhaust gas passes through the compressor is and ATAAC. An example of such an EGR system is disclosed in U.S. Pat. No. 5,802,846 (Bailey) issued on Sep. 8, 1998, which is assigned to the assignee of the present invention.

With conventional EGR systems as described above, the exhaust gas may be drawn from only a subset of the combustion cylinders within the engine, and driven back into the intake manifold. For example, the exhaust gas may be drawn from only a single cylinder of a multi-cylinder engine. In the case of a six cylinder engine, such a single cylinder EGR system would provide one-sixth of the available exhaust gases to the intake manifold, thereby providing an EGR rate of approximately 17 percent. Such an EGR rate, however, is too high under certain operating conditions, such as when the engine is operating under a peak torque condition.

Also, it is known to control the operation of the EGR valve of such conventional EGR systems by using a negative pressure source, such as an intake manifold, to sense low load conditions. However, operation of the EGR valve based on pressure changes can be adversely affected by leaks in the negative pressure source, and leaks or blockages in the control line coupling the EGR valve to the negative pressure source.

The present invention is directed to overcoming one or more of the problems as set forth above.

DISCLOSURE OF THE INVENTION

In one aspect of the invention, an internal combustion engine comprises a block defining a plurality of combustion cylinders, each combustion cylinder of the plurality of combustion cylinders having a displacement volume. An intake manifold provides combustion air to each combustion cylinder. An exhaust manifold includes cylinder ports fluidly connected to each combustion cylinder for selectively transporting exhaust gas therefrom through at least one of a primary exhaust outlet and a secondary exhaust outlet. An exhaust gas recirculation valve is fluidly connected between the intake manifold and the secondary exhaust outlet, and wherein the exhaust gas recirculation valve is controllably positioned in one of a first position and a second position. When the exhaust gas recirculation valve is in the first position the exhaust gas from each combustion cylinder is transported through the primary exhaust outlet, and when the exhaust gas recirculation valve is in the second position an exhaust gas flow from at least one of the plurality of combustion cylinders is transported through the secondary exhaust outlet. An actuator communicates with the exhaust gas recirculation valve for effecting a position change of the exhaust gas recirculation valve. A controller is coupled to the actuator to control a timing of movement of the exhaust gas recirculation valve between the first position and the second position based on at least one cyclical engine operation characteristic.

Another aspect of the invention is an exhaust gas recirculation system for an internal combustion engine. The internal combustion engine has a crankshaft, a block defining a plurality of combustion cylinders, a cylinder head having an exhaust valve, an intake manifold for providing combustion air to each cylinder of the plurality of combustion cylinders, and an exhaust manifold having cylinder ports fluidly connected to each cylinder for selectively transporting exhaust gas therefrom through at least one of a primary exhaust outlet and a secondary exhaust outlet.

The exhaust gas recirculation system comprises an exhaust gas recirculation valve adapted for coupling to the intake manifold and adapted for connection to the secondary exhaust outlet, the exhaust gas recirculation valve being controllably positioned in one of a first position and a second position, wherein when the exhaust gas recirculation valve is in the first position the exhaust gas from each cylinder is transported through the primary exhaust outlet, and when the exhaust recirculation valve is in the second position an exhaust gas flow from at least one of the plurality of combustion cylinders is transported through the secondary exhaust outlet. Also, the exhaust gas recirculation system comprises an actuator in communication with the exhaust gas recirculation valve for effecting a position change of the exhaust gas recirculation valve and a controller coupled to the actuator to control a timing of movement of the exhaust gas recirculation valve between the first position and the second position based on at least one cyclical engine operation characteristic of the internal combustion engine.

In still another aspect of the invention, a is method of recirculating exhaust gas in an internal combustion engine comprises the steps of providing a plurality of combustion cylinders having a displacement volume; providing an intake manifold for providing combustion air to each combustion cylinder; providing an exhaust manifold having cylinder ports fluidly connected to each combustion cylinder for selectively transporting exhaust gas therefrom through at least one of a primary exhaust outlet and a secondary exhaust outlet; providing an exhaust gas recirculation valve fluidly connected between the intake manifold and the secondary exhaust outlet; and controlling a timing of movement of the exhaust gas recirculation valve between a first position and a second position based on at least one cyclical engine operation characteristic, wherein when the exhaust gas recirculation valve is in the first position the exhaust gas from each combustion cylinder is transported through the primary exhaust outlet, and when the exhaust gas recirculation valve is in the second position an exhaust gas flow from at least one of the plurality of combustion cylinders is transported through the secondary exhaust outlet.

BEST MODE FOR CARRYING OUT THE INVENTION

Figure 1:
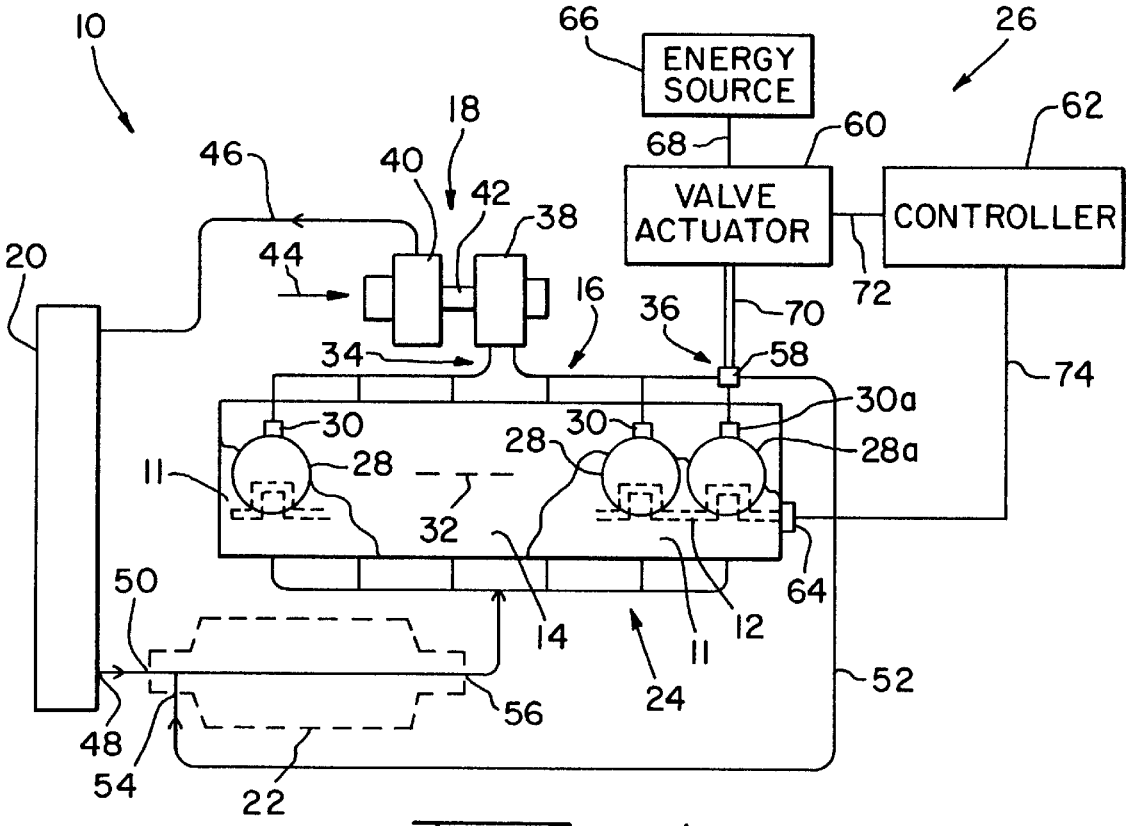
FIG. 1 is a schematic illustration of an embodiment of an internal combustion engine of the present invention.

Referring now to the drawings, and more particularly to FIG. 1, there is shown a schematic representation of an embodiment of an internal combustion engine 10 of the present invention. Internal combustion engine 10 generally includes a block 11, a crankshaft 12, a cylinder head 14, exhaust manifold 16, turbocharger 18, ATAAC 20, mixing vessel 22, intake manifold 24 and an EGR control system 26.

Block 11 defines a plurality of combustion cylinders 28. The exact number of combustion cylinders 28 may be selected dependent upon a specific application, as indicated by dashed line 32. For example, block 11 may include six, ten or twelve combustion cylinders 28, including an end cylinder 28*a*. Each combustion cylinder 28 has a displacement volume which is the volumetric change within each combustion cylinder 28 as an associated piston (not shown) moves from a bottom dead center to a top dead center position, or vice versa. The displacement volume may be selected dependent upon the specific application of internal combustion engine 10. The sum of the displacement volumes for each of combustion cylinders 28 defines a total displacement volume for internal combustion engine 10.

Cylinder head 14 is connected to block 11 in a manner known to those skilled in the art, and is shown with a section broken away to expose block 11. As each of the pistons moves to its respective top dead center position, each piston and the cylinder head 14 define a combustion chamber therebetween. Cylinder head 14 can be constructed as a single part cylinder head or a multi-part cylinder head. In the embodiment shown, cylinder head 14 includes a plurality of exhaust valves 30, including an end cylinder exhaust valve 30*a*.

Exhaust manifold 16 has cylinder ports fluidly connected to cylinder head 14 to receive combustion products from combustion cylinders 28 and transports the combustion products to at least one of a primary exhaust outlet 34 and a secondary exhaust outlet 36 through which the combustion products are discharged.

Turbocharger 18 includes a turbine 38 and a compressor 40. Turbine 38 is driven by the exhaust gases which flow from outlet 34 of exhaust manifold 16. Turbine 38 is coupled with compressor 40 via shaft 42 and rotatably drives compressor 40. Compressor 40 receives combustion air from the ambient environment (as indicated by line 44) and provides compressed combustion air via fluid conduit 46.

ATAAC 20 receives the compressed combustion air from compressor 40 via fluid conduit 46 and cools the combustion air. In general, ATAAC 20 is a heat exchanger including one or more fluid passageways through which the compressed combustion air flows. Cooling air flows around the fluid passageways to cool the combustion air transported through the passageways. The cooled combustion air is transported from ATAAC 20 through outlet 48.

Mixing vessel 22 receives the cooled and compressed combustion air from ATAAC 20 at inlet 50. In addition, mixing vessel 22 also receives exhaust gas from exhaust manifold 16 via fluid conduit 52 at a second inlet 54. The exhaust gas flows through fluid conduit 52 and enters into mixing vessel 22 in a parallel flow arrangement with respect to the cooled and compressed combustion air entering through first inlet 50. The combustion air and exhaust gas mix within mixing vessel 22 and the mixture is transported through an outlet 56 to intake manifold 24. Intake manifold 24 provides the mixture of charged combustion air and exhaust gas to the individual combustion cylinders 28.

EGR system 26 includes an EGR valve assembly 58, a valve actuator 60, a controller 62, a sensor 64, and an energy source 66.

Preferably, valve actuator 60 is a fluid actuator and energy source 66 is a fluid source, such as a fluid pump. The working fluid can be, for example, hydraulic oil or air. A connector 68 provides a conduit which fluidly connects valve actuator 60 to source 66. Accordingly, energy source 66 supplies fluid under pressure via connector 68 to valve actuator 60. The fluid under pressure is selectively supplied to a fluid piston 70 which effects the operation of EGR valve assembly 58.

Valve actuator 60 is further electrically coupled to controller 62 via a conductor 72. Controller 62 sends control signals via conductor 72 to a switching device (not shown) in valve actuator 60, which in turn selectively permits passage of the pressurized fluid from energy source 66 to fluid piston 70.

Those skilled in the art will recognize that, alternatively, valve actuator 60, energy source 66 and connector 68 could be formed from electrical components analogous to the above-described and preferred fluid components.

Preferably, controller 62 includes a microprocessor and associated memory (not shown) which effect the generation of appropriate control signals based upon one or more cyclical engine operating characteristics, such as for example, crankshaft rotational position, exhaust valve lift position, etc. Assuming that internal combustion engine 10 is a four stroke engine, a complete cycle (intake, compression, power, and exhaust) occurs during two revolutions of the crankshaft (i.e., 720°). The exhaust valves, which are typically operated by a camshaft driven by the crankshaft, are each selectively opened for a duration of, for example, about 220° to 280° of crankshaft rotation during each cycle.

Thus, preferably, sensor 64 communicates with crankshaft 12 to sense a rotational position, or crank angle, of crankshaft 12. Such a crankshaft rotational position sensor, which includes a driven portion and a stationary portion (not shown), is well known in the art. The driven portion moves in conjunction with the rotation of crankshaft 12, and the stationary portion includes a pickup which detects the movement of the driven portion. Thus, sensor 64 could be accomplished, for example, by using an encoded wheel and associated reader, or a magnet and an associated Hall-effect transistor.

Sensor 64 generates a sense signal which is supplied via conductor 74 to controller 62 for processing. Controller 62 processes the sense signal and generates the control signal, which is supplied via conductor 72 to valve actuator 60. Upon receiving the control signal, valve actuator communicates with EGR valve assembly 58 via piston 70 to effect the operation of EGR valve assembly 58. More particularly, EGR valve assembly 58 is controlled to permit the intermittent passage of a flow of exhaust gas from exhaust manifold 16 through fluid conduit 52 to mixing vessel 22.

Figure 2:
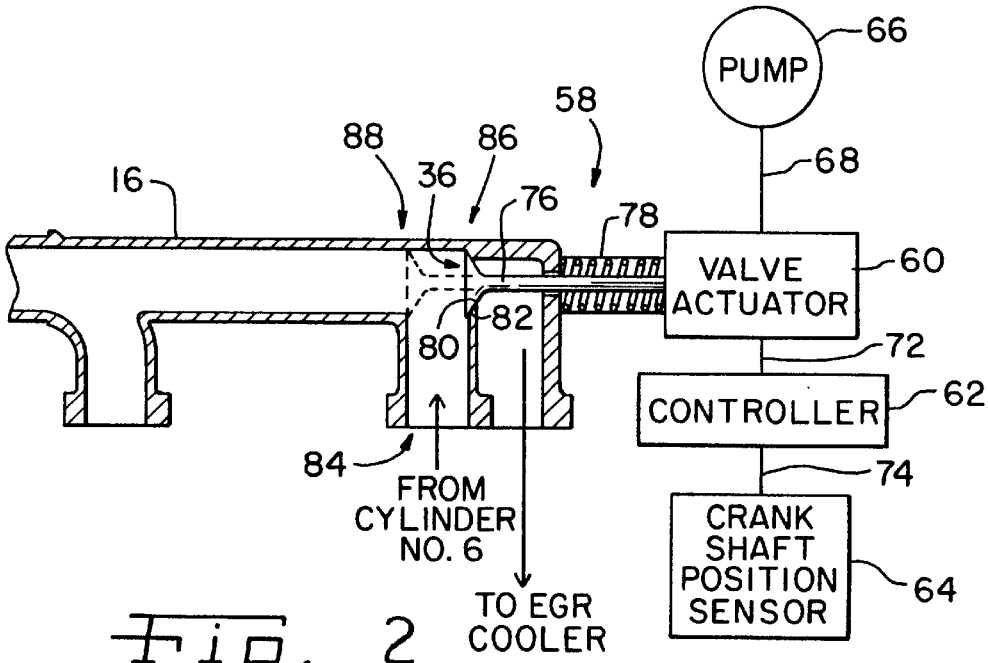
FIG. 2 is a side, sectional view of the exhaust manifold shown in FIG. 1, with the remainder of the components shown in schematic.

As shown in FIG. 2, preferably, EGR valve assembly 58 is associated with exhaust gas from only one of cylinders 28, and is formed integral with exhaust manifold 16. EGR valve assembly 58 includes a poppet EGR valve 76 which is held in a normally closed, or first, position 86 by a return spring 78. In the normally closed position 86, a beveled surface 80 of valve 76 contacts an annular EGR valve seat 82 formed in exhaust manifold 16, and piston 70 is retracted into valve actuator 60. When EGR valve 76 in the closed position 86, all exhaust gas from all cylinders 28 is supplied to primary exhaust outlet 34. When piston 70 of valve actuator 60 is extended, EGR valve 76 is moved to an open, or second, position 88 (shown by phantom lines) and EGR valve 76 effectively blocks the exhaust path from exhaust manifold inlet 84 to primary exhaust outlet 34, and opens an exhaust flow path from exhaust manifold inlet 84 through secondary exhaust outlet 36. Accordingly, the selective operation of EGR valve 76 to the open position results in a flow of exhaust gas to mixing vessel 22 of a pulsed nature, as illustrated in FIGS. 3A–3C.

Figure 3A:
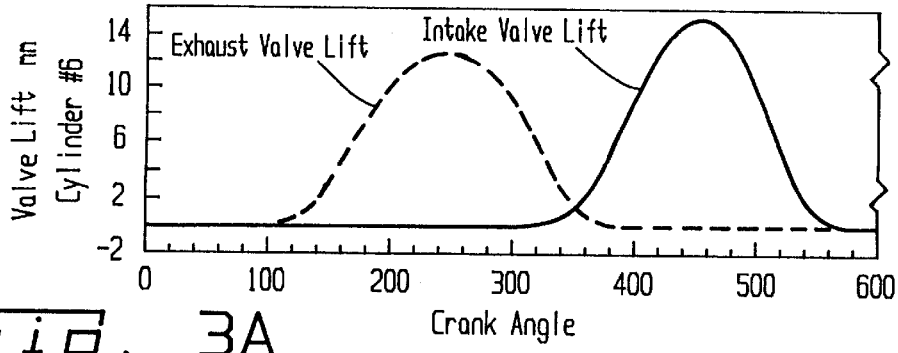
FIGS. 3A–3D graphically illustrate the operation of a exhaust gas recirculation valve in relation to cyclical operational characteristics of the internal combustion engine as shown in FIG. 1.

FIG. 3A, in relation to FIG. 1, graphically illustrates the exhaust valve and intake valve operation cycle for cylinder 28*a* of internal combustion engine 10 in terms of valve lift, and further in relation to crankshaft rotational position, or crank angle, of crankshaft 12. For purposes of this discussion, cylinder 28*a* is assumed to be the sixth cylinder of a total of six cylinders 28 of internal combustion engine 10. The associated intake valve (not shown) begins to open at a crank angle of about 320° and becomes fully closed at about 560°, resulting in a duration of about 240°. The associated exhaust valve 30*a* begins to open at a crank angle of about 100° and becomes fully closed at about 360°, resulting in a duration of about 260°. When exhaust valve 30*a* is in open position 88, a flow of exhaust gas is directed from cylinder 28*a* into exhaust manifold 16. Exhaust valve 30*a* is closed during the remaining 460° of the four stroke cycle.

Figure 3B:
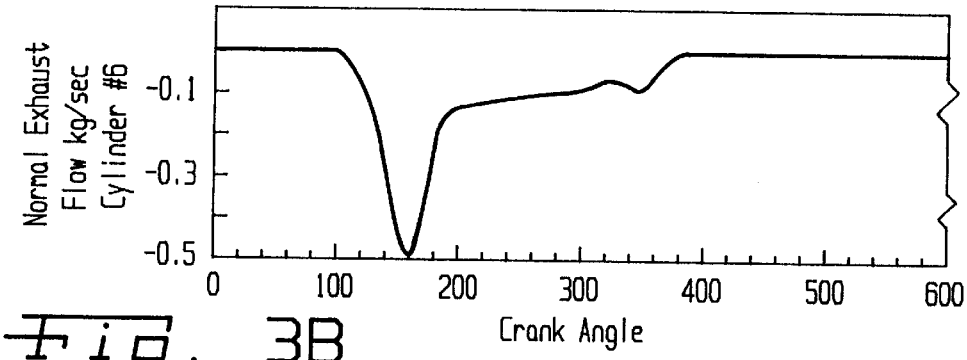

FIG. 3B graphically depicts the exhaust gas flow from sixth cylinder 28*a*. As shown, about 50 percent of the exhaust gas flow occurs between crank angles of about 100° to about 180°, with peak flow occurring at about 160°.

Figure 3C:
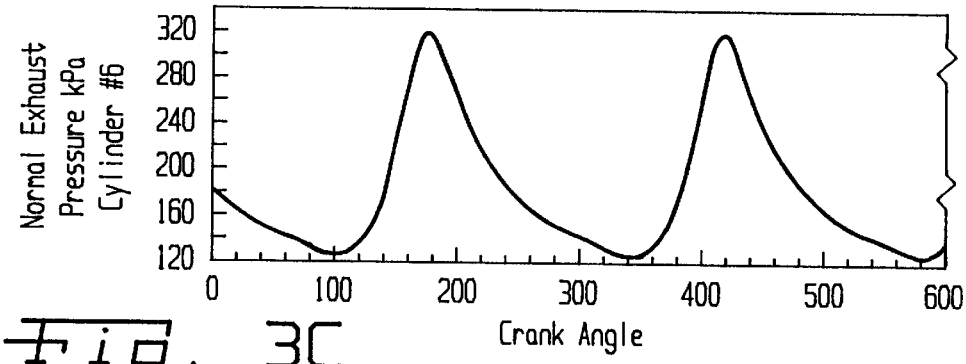

FIG. 3C graphically depicts exhaust manifold pressure at a location near exhaust inlet 84 of sixth cylinder 28*a*. Peak exhaust pressure occurs at a crank angle of about 170°.

Figure 3D:
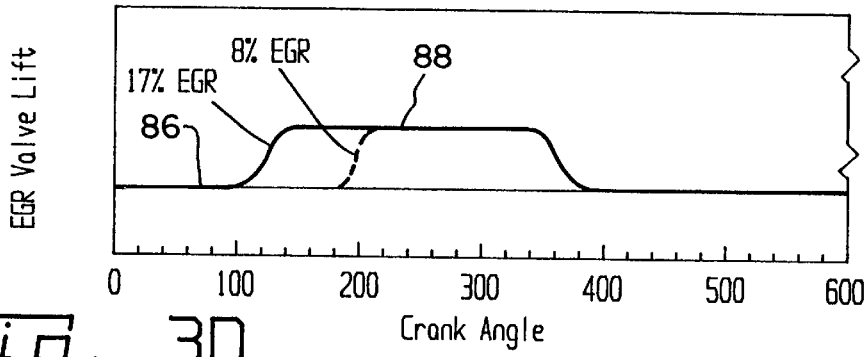

FIG. 3D graphically illustrates the operation of EGR valve 76 in relation to the crank angle of crankshaft 12, which can be further compared to FIG. 3A to determine a relationship to the exhaust valve lift of exhaust valve 30*a*. As illustrated in FIG. 3D, EGR valve 76 is operable between the closed position 86 and the open position 88 to permit a variable amount of exhaust gas from cylinder 28*a* to be diverted through secondary exhaust outlet 36 (see FIG. 2). Assuming a six cylinder engine, and by way of example, diverting 100 percent of the exhaust gas from cylinder 28*a* to secondary exhaust outlet 36 will result in an EGR rate of about 17 percent for internal combustion engine 10, whereas diverting 50 percent of the exhaust gas from cylinder 28*a* to secondary exhaust outlet 36 will result in an EGR rate of about 8 percent.

Preferably, controller 62 includes control logic which permits a selection of an EGR rate in a range from 0 percent through 17 percent, resulting in the diversion of 0 percent through 100 percent of the exhaust gas from sixth cylinder 28*a* to intake manifold 24. By changing the time of application of the control signal from controller 62 to valve actuator 60, the EGR valve timing can be varied. For example, as shown in FIG. 3D, if the EGR valve is actuated at a crank angle of about 100° for a duration of about 280°, an EGR rate of 17% is achieved. If, however, an EGR rate of about 8 percent is desired, the lift start for EGR valve 76 is delayed until a crank angle of about 180° and maintained for a duration of 200°. Alternatively, the timing of the closing of EGR valve 76 can be changed, or the timing of both the opening and closing of EGR valve 76 can be varied, to provide the desired EGR rate. Thus, by collectively comparing the illustrations of FIGS. 3A–3D, it is shown that the EGR rate of internal combustion engine 10 depends upon the timing of valve opening of EGR valve 76 and/or the duration of opening of EGR valve 76 in relation to the lift position of exhaust valve 30*a*, and further in relation to the crank angle of crankshaft 12.

INDUSTRIAL APPLICABILITY

During use, a plurality of pistons (not shown) reciprocate within combustion cylinders 28 (see FIG. 1). Combustion occurs within combustion cylinders 28 either via compression ignition in the case of a diesel engine or via spark ignition in the case of a gasoline engine. The exhaust gases which are discharged from combustion cylinders 28 flow through exhaust manifold 16 to turbine 38 of turbocharger 18. Turbine 38 rotatably drives compressor 40 which receives combustion air and provides compressed combustion air to ATAAC 20. The cooled and compressed combustion air flows into mixing vessel 22. In addition, exhaust gas is controllably injected into mixing vessel 22 in a parallel relationship with respect to the combustion air.

Controller 62 includes preprogrammed instructions for processing information relating to at least one cyclical engine operation characteristic, such as crankshaft rotational position information or exhaust valve lift information, for controlling an EGR rate of internal combustion engine 10. Preferably, this information is supplied to controller 62 by sensor 64, which is in communication with crankshaft 12. Depending upon the desired EGR rate, the timing of the opening, closing and/or duration of EGR valve 76 is determined, and a suitable control signal is generated. The control signal is supplied to valve actuator 60, which in turn effects a change in the position of EGR valve 76 from a closed, or first, position to an open, or second position, based upon the cyclical engine operation characteristic information.

When EGR valve 76 is in the closed position 86, the exhaust gas from all cylinders is supplied to primary exhaust outlet 34. When EGR valve 76 is in the open position 88, EGR valve 76 effectively blocks the exhaust path from exhaust manifold inlet 84 to primary exhaust outlet 34, and opens an exhaust flow path from exhaust manifold inlet 84 through secondary exhaust outlet 36 to intake manifold 24 via mixing vessel 22. Thus, an exhaust gas flow through secondary exhaust outlet 36 is recirculated back through the intake manifold 24 for combustion in combustion cylinders 28.

Accordingly, an exhaust gas recirculation system of the invention advantageously provides variable valve timing for an EGR valve based on at least one cyclical engine operating characteristic.

Other aspects, objects and advantages of this invention can be obtained from a study of the drawings, the disclosure and the appended claims.

What is claimed is:

1. An internal combustion engine, comprising:

a block defining a plurality of combustion cylinders, each combustion cylinder of said plurality of combustion cylinders having a displacement volume;

an intake manifold for providing combustion air to each said combustion cylinder;

an exhaust manifold having cylinder ports fluidly connected to each said combustion cylinder for selectively transporting exhaust gas therefrom through at least one of a primary exhaust outlet and a secondary exhaust outlet;

an exhaust gas recirculation valve fluidly coupled between said intake manifold and said secondary exhaust outlet, said exhaust gas recirculation valve being controllably positioned in one of a first position and a second position, wherein when said exhaust gas recirculation valve is in said first position said exhaust gas from each said combustion cylinder is transported through said primary exhaust outlet, and when said exhaust gas recirculation valve is in said second position an exhaust gas flow from at least one of said plurality of combustion cylinders is transported through said secondary exhaust outlet;

an actuator in communication with said exhaust gas recirculation valve for effecting a position change of said exhaust gas recirculation valve; and a controller coupled to said actuator to control a timing of movement of said exhaust gas recirculation valve between said first position and said second position based on at least one cyclical engine operation characteristic.

2. The internal combustion engine of claim 1, wherein an amount of said exhaust gas flow transported by said secondary exhaust outlet is selectable by said controller to effect one of an EGR rate for said internal combustion engine within a range of 0 percent through 17 percent and a percentage of a total gas flow from said at least one of said plurality of combustion cylinders within a range from 0 percent through 100 percent.

3. The internal combustion engine of claim 2, wherein said amount of said exhaust gas flow is dependent upon a duration when said exhaust gas recirculation valve is not in said first position.

4. The internal combustion engine of claim 1, including at least one cylinder head coupled to said block, said at least one cylinder head having an exhaust valve which moves between a closed position and an open position, and wherein said cyclical engine operation characteristic is a lift position of said exhaust valve.

5. The internal combustion engine of claim 1, further comprising a crankshaft, and wherein said cyclical engine operation characteristic is a rotational position of said crankshaft.

6. The internal combustion engine of claim 5, further comprising a crankshaft position sensor in communication with said crankshaft, said crankshaft position sensor being coupled to said controller to provide crankshaft rotational position information to said controller, said controller processing said crankshaft rotational position information to generate a control signal and supply said control signal to said actuator to control said timing of movement of said exhaust gas recirculation valve between said first position and said second position.

7. The internal combustion engine of claim 1, further comprising a sensor for detecting said at least one cyclical engine operation characteristic.

8. The internal combustion engine of claim 7, including at least one cylinder head coupled to said block, said at least one cylinder head having an exhaust valve which moves between a closed position and an open position, and wherein said cyclical engine operation characteristic is a lift position of said exhaust valve.

9. The internal combustion engine of claim 8, further comprising a crankshaft, wherein said sensor is in communication with said crankshaft to provide crankshaft rotational position information to said controller.

10. The internal combustion engine of claim 9, wherein said controller processes said crankshaft rotational position information to generate a control signal and supply said control signal to said actuator to control said timing of movement of said exhaust gas recirculation valve between said first position and said second position, and wherein based upon said timing of movement of said exhaust gas recirculation valve, an amount of said exhaust gas flow transported by said secondary exhaust outlet is selectable by said controller to effect one of an EGR rate for said internal combustion engine within a range of 0 percent through 17 percent and a percentage of a total gas flow from said at least one of said plurality of combustion cylinders within a range from 0 percent through 100 percent.

11. The internal combustion engine of claim 10, wherein said amount of said exhaust gas flow is dependent upon a time duration of when said exhaust gas recirculation valve is not in said first position.

12. An exhaust gas recirculation system for an internal combustion engine, said internal combustion engine having a crankshaft, a block defining a plurality of combustion cylinders, a cylinder head having an exhaust valve, an intake manifold for providing combustion air to each cylinder of said plurality of combustion cylinders, and an exhaust manifold having cylinder ports fluidly connected to said each cylinder for selectively transporting exhaust gas therefrom through at least one of a primary exhaust outlet and a secondary exhaust outlet, said exhaust gas recirculation system comprising:

an exhaust gas recirculation valve adapted for coupling to said intake manifold and adapted for connection to said secondary exhaust outlet, said exhaust gas recirculation valve being controllably positioned in one of a first position and a second position, wherein when said exhaust gas recirculation valve is in said first position said exhaust gas from each cylinder is transported through said primary exhaust outlet, and when said exhaust recirculation valve is in said second position an exhaust gas flow from at least one of said plurality of combustion cylinders is transported through said secondary exhaust outlet;

an actuator in communication with said exhaust gas recirculation valve for effecting a position change of said exhaust gas recirculation valve; and a controller coupled to said actuator to control a timing of movement of said exhaust gas recirculation valve between said first position and said second position based on at least one cyclical engine operation characteristic of said internal combustion engine.

13. The exhaust gas recirculation system of claim 12, wherein said cyclical engine operation characteristic comprises one of a lift position of said exhaust valve and a rotational position of said crankshaft of said internal combustion engine.

14. The exhaust gas recirculation system of claim 12, further comprising a crankshaft position sensor adapted for communication with said crankshaft, said crankshaft position sensor being coupled to said controller to provide crankshaft rotational position information to said controller, said controller processing said crankshaft rotational position information to generate and supply a control signal to said actuator to control said timing of movement of said exhaust gas recirculation valve between said first position and said second position.

15. The exhaust gas recirculation system of claim 12, wherein an amount of said exhaust gas flow transported by said secondary exhaust outlet is selectable by said controller to effect one of an EGR rate for said internal combustion engine within a range of 0 percent through 17 percent and a percentage of a total gas flow from said at least one of said plurality of combustion cylinders within a range from 0 percent through 100 percent.

16. The exhaust gas recirculation system of claim 15, wherein said amount of said exhaust gas flow is dependent upon a duration when said exhaust gas recirculation valve is not in said first position.

17. A method of recirculating exhaust gas in an internal combustion engine, comprising the steps of:

providing a plurality of combustion cylinders, each combustion cylinder of said plurality of combustion cylinders having a displacement volume;

providing an intake manifold for providing combustion air to each said combustion cylinder;

providing an exhaust manifold having cylinder ports fluidly connected to each said combustion cylinder for selectively transporting exhaust gas therefrom through at least one of a primary exhaust outlet and a secondary exhaust outlet;

providing an exhaust gas recirculation valve fluidly connected between said intake manifold and said secondary exhaust outlet; and controlling a timing of movement of said exhaust gas recirculation valve between a first position and a second position based on at least one cyclical engine operation characteristic, wherein when said exhaust gas recirculation valve is in said first position said exhaust gas from each said combustion cylinder is transported through said primary exhaust outlet, and when said exhaust gas recirculation valve is in said second position an exhaust gas flow from at least one of said plurality of combustion cylinders is transported through said secondary exhaust outlet.

18. The method of claim 17, wherein in said controlling step said cyclical engine operation characteristic includes one of a lift position of an exhaust valve and a rotational position of a crankshaft.

19. The method of claim 18, wherein said controlling step further comprises the step of selecting a timing of movement of said exhaust gas recirculation valve to control an amount of said exhaust gas flow transported by said secondary exhaust outlet to effect one of an EGR rate for said internal combustion engine selectable within a range of 0 percent through 17 percent and a percentage of a total gas flow from said at least one of said plurality of combustion cylinders selectable within a range from 0 percent through 100 percent.

20. The method of claim 19, wherein said controlling step further comprises the step of selecting a time duration of when said exhaust gas recirculation valve is not in said first position.

* * * * *